US010973265B2

(12) United States Patent
Inzer

(10) Patent No.: US 10,973,265 B2
(45) Date of Patent: Apr. 13, 2021

(54) ADJUSTABLE SUPPORT PANTS OR BRIEFS

(71) Applicant: John Inzer, Longview, TX (US)

(72) Inventor: John Inzer, Longview, TX (US)

(73) Assignee: INZER ADVANCE DESIGNS, INC., Longview, TX (US)

( * ) Notice: Subject to any disclaimer, the term of this patent is extended or adjusted under 35 U.S.C. 154(b) by 178 days.

(21) Appl. No.: 14/809,434

(22) Filed: Jul. 27, 2015

(65) Prior Publication Data

US 2017/0027252 A1 Feb. 2, 2017

(51) Int. Cl.
*A41D 1/089* (2018.01)
*A41B 9/00* (2006.01)

(52) U.S. Cl.
CPC ..... *A41D 1/089* (2018.01); *A41B 9/001* (2013.01); *A41D 2300/30* (2013.01); *A41D 2300/50* (2013.01); *A41D 2400/38* (2013.01); *A41D 2600/10* (2013.01)

(58) Field of Classification Search
CPC . A41D 15/00; A41D 1/06; A41D 1/08; A41D 2300/30; A41D 2300/50; A41D 2400/38; A41D 2400/44; A41D 2400/70; A41D 2600/10; A41B 9/001; A41B 2400/70
USPC ..... 2/227, 228, 238, 23; 450/107, 108, 119, 450/132, 134, 135, 136, 137, 138, 141
See application file for complete search history.

(56) References Cited

U.S. PATENT DOCUMENTS 188,940 A * 3/1877 Packscher ..... A41B 9/04 2/237
280,444 A * 7/1883 Bush ..... A41F 9/02 2/237
362,565 A * 5/1887 Yarwood ..... A41B 9/001 2/237
682,503 A * 9/1901 Strasburger ..... A41C 1/00 450/132
1,061,697 A 5/1913 Sobra
1,888,086 A * 11/1932 Jackson ..... A41D 27/20 2/227
1,986,792 A * 1/1935 Calvo ..... A41D 7/00 2/67

(Continued)

FOREIGN PATENT DOCUMENTS

CA 2646918 A1 * 6/2010 ..... A41D 1/06
DE 2302607 A1 * 7/1974 ..... A41D 15/00

(Continued)

*Primary Examiner* — Jameson D Collier
*Assistant Examiner* — F Griffin Hall
(74) *Attorney, Agent, or Firm* — Dinsmore & Shohl LLP

(57) ABSTRACT

Adjustable support pants or briefs are provided which include one or more of a waist section, hip support section, or leg section with leg openings. The support pants or briefs include first and second adjustable members positioned on opposite sides of a sagittal plane of the support pants or briefs which extend generally longitudinally along the garment. The adjustable members are adapted to increase or decrease at least one of the waist, hip, or leg opening circumferences to reduce the time and effort needed to don (and take off) the garment. The adjustable features of the support pants or briefs also permit the wearer to tighten one or more sections of the garment to accommodate the different physiques of wearers while providing a snug fit and support during athletic or work activities.

22 Claims, 10 Drawing Sheets

(56) References Cited

U.S. PATENT DOCUMENTS 2,260,526 A * 10/1941 Hodovan ..... A41D 1/08 2/228
2,285,692 A 6/1942 Wickman
2,292,227 A * 8/1942 Kopyto ..... A41D 7/005 2/67
2,329,093 A * 9/1943 Sommers ..... A41D 7/001 441/102
2,409,601 A * 10/1946 Truesdell ..... A41C 1/10 450/94
D151,885 S * 11/1948 Hamilton ..... D2/734
2,520,026 A * 8/1950 Beitchman ..... A41D 10/00 2/227
2,586,658 A * 2/1952 Hormann ..... A61F 5/03 450/96
2,587,450 A * 2/1952 Ericsson ..... A41C 1/10 450/136
2,591,513 A 4/1952 Cormier
2,616,087 A 11/1952 Werber
2,871,849 A * 2/1959 Clark ..... B63C 11/04 600/20
3,110,903 A * 11/1963 Burchard ..... A41D 1/08 2/211
3,763,579 A 10/1973 Dexter
3,771,169 A * 11/1973 Edmund ..... B63C 11/04 2/2.17
3,789,429 A 2/1974 Garcia
4,117,609 A 10/1978 Helt
4,143,663 A * 3/1979 Williams ..... A41C 1/003 450/103
4,145,763 A * 3/1979 Abrams ..... A41B 9/007 128/DIG. 15
4,293,957 A * 10/1981 Melarvie ..... A41D 13/012 2/2.17
4,384,369 A * 5/1983 Prince ..... A63B 21/065 2/227
4,547,904 A * 10/1985 Long ..... A41D 13/012 2/135
4,619,058 A 10/1986 Gumbert
4,638,509 A 1/1987 Charron
4,675,918 A * 6/1987 O'Brien ..... A41B 9/007 2/402
4,894,867 A 1/1990 Ceravolo et al.
5,002,270 A * 3/1991 Shine ..... A63B 21/065 2/102
5,033,126 A * 7/1991 Wruck ..... A41D 1/08 2/242
5,109,546 A * 5/1992 Dicker ..... A41D 13/0015 2/227
5,157,790 A * 10/1992 Aldridge ..... A41D 13/0525 2/227
D337,194 S * 7/1993 Marks ..... D2/738
5,315,716 A * 5/1994 Baum ..... A41D 1/06 2/114
5,359,731 A * 11/1994 Cavalier ..... A41D 1/06 2/227
5,511,245 A 4/1996 Hayes
5,628,064 A 5/1997 Chung
5,802,611 A * 9/1998 McKenzie ..... A41D 13/1236 2/114
5,822,793 A * 10/1998 Tokura ..... A41B 13/00 2/227
5,918,310 A * 7/1999 Farahany ..... A41D 13/015 2/228
6,049,913 A 4/2000 Harrigan
6,178,562 B1 * 1/2001 Elkins ..... A41D 13/005 2/102
6,243,880 B1 6/2001 Lyden
6,279,161 B1 * 8/2001 Johnston ..... A41D 13/0015 2/115
6,282,717 B1 * 9/2001 Ng ..... A41D 1/04 2/115
6,719,712 B2 4/2004 Zigmont
D504,202 S 4/2005 Coutant
7,131,147 B2 * 11/2006 Villegas ..... A41D 1/14 2/211
D567,477 S * 4/2008 Smith ..... D2/742
7,516,499 B2 * 4/2009 Gardner, III ..... A41D 1/20 2/221
D620,230 S * 7/2010 Rollins ..... D2/742
7,832,022 B1 * 11/2010 Peters ..... A41D 1/08 2/227
7,958,571 B2 6/2011 Kitsch et al.
8,032,944 B2 10/2011 Demetropoulos
8,214,927 B1 * 7/2012 Jondahl ..... A41D 13/0525 2/22
8,464,365 B1 * 6/2013 Nunn ..... A41D 1/08 2/227
8,510,972 B2 8/2013 Bizzo
8,578,517 B2 11/2013 Alaniz et al.
8,819,865 B1 9/2014 Crye
D746,544 S * 1/2016 Curran ..... D2/738
D756,598 S * 5/2016 Pierorazio ..... D2/742
9,999,264 B2 6/2018 Inzer
2003/0229930 A1 * 12/2003 Carlson ..... A41D 13/1254 2/114
2005/0034205 A1 * 2/2005 Green ..... A63B 21/0004 2/69
2005/0166298 A1 * 8/2005 Pieroranzio ..... A41D 1/06 2/69
2006/0048262 A1 * 3/2006 Sencion ..... A41D 15/005 2/69
2006/0053658 A1 3/2006 Voughlohn
2007/0028362 A1 * 2/2007 Cash, Jr. ..... A41D 1/08 2/227
2008/0196138 A1 8/2008 Takeuchi
2008/0235847 A1 10/2008 Alaniz et al.
2009/0025115 A1 * 1/2009 Duffy ..... A41D 1/04 2/69
2009/0088306 A1 4/2009 Alaniz et al.
2009/0178174 A1 * 7/2009 Cash, Jr. ..... A41D 1/08 2/69
2010/0005576 A1 * 1/2010 Andrews ..... A41D 13/088 2/468
2010/0299804 A1 * 12/2010 Huang ..... A41D 1/06 2/93
2011/0009793 A1 * 1/2011 Lucero ..... A41D 13/0015 602/62
2011/0113523 A1 5/2011 Lobas
2011/0197330 A1 * 8/2011 Simpson ..... A41D 7/00 2/67
2011/0209264 A1 9/2011 Williams et al.
2011/0219512 A1 9/2011 Davis
2011/0283436 A1 11/2011 Alaniz et al.
2012/0053553 A1 * 3/2012 Griggs ..... A41B 9/00 604/396
2012/0073028 A1 3/2012 Knopik
2012/0240312 A1 * 9/2012 Taylor-Barry ..... A41D 13/1254 2/227
2012/0304361 A1 * 12/2012 Jeffords ..... A41D 1/06 2/227
2013/0254969 A1 * 10/2013 Getzen ..... A41D 27/00 2/108
2013/0289512 A1 * 10/2013 Rhodes ..... A41B 9/001 604/385.24
2014/0325734 A1 * 11/2014 Kuelker ..... A41D 13/02 2/79
2015/0128333 A1 * 5/2015 Atallah ..... A62B 17/001 2/455
2015/0191232 A1 * 7/2015 Hussey ..... B63C 11/04 2/2.15
2016/0095367 A1 4/2016 Curran
2017/0027235 A1 2/2017 Inzer

FOREIGN PATENT DOCUMENTS

DE 10203586 A1 * 10/2003 ..... A41D 1/06
FR 723921 A * 4/1932 ..... A41D 15/00
FR 1016741 A * 11/1952 ..... A41D 15/00
FR 2747541 A3 * 10/1997 ..... A41B 9/00

(56) References Cited

FOREIGN PATENT DOCUMENTS

| | | | | |
|---|---|---|---|---|
| FR | 2863456 | A1 * | 6/2005 | ..... A41D 13/0015 |
| FR | 2883457 | A1 * | 9/2006 | ..... A41D 3/06 |
| JP | WO 2006043565 | A1 * | 4/2006 | ..... A41D 15/00 |
| WO | WO 0201976 | A1 * | 1/2002 | ..... A41D 13/0012 |

* cited by examiner

ADJUSTABLE SUPPORT PANTS OR BRIEFS

BACKGROUND

The subject matter described herein relates to adjustable support pants or briefs worn for athletic or work activities that involve the lifting of heavy weights, and in particular embodiments, to adjustable support pants or briefs for weightlifting.

Weightlifting suits and pants have been a staple of personal gear to increase performance during powerlifting exercises. Weightlifting suits are traditionally referred to as squat suits and deadlift suits. A squat suit is worn when performing the squat exercise. The squat, also known as the "deep knee bend," is performed by placing a barbell on the shoulders of the lifter and then squatting down and pushing back up to standing position.

A deadlift suit is worn when performing the deadlift. The deadlift is performed by grasping a barbell positioned on the floor, and pulling the barbell upward until the lifter is standing upright. Both squat suits and deadlift suits cover and support the upper portions of the legs, the buttocks, and the torso of a wearer. The suits have shoulder straps extending around both shoulders to secure the suit on the body of the lifter. Other suits are designed to provide assistance to the lifter for weightlifting competition exercises such as the snatch, clean-and-jerk, and other activities where the hips and/or torso bend during a weight-lifting movement. A similar type of weightlifting suit, known as Power Pants™ or powerlifting briefs, is commercially available. A powerlifting brief typically comprises the lower part of a squat suit without the torso portion and shoulder straps.

Squat suits, deadlift suits, powerlifting pants, and other weightlifting garments are generally made of high tensile strength fabrics such as double knit polyester, canvas, or denim, and extend tightly around the buttocks and thighs of a wearer. While such garments support and aid the wearer during lifting movements, the tautness of the fabric and snugness of the sizing makes it difficult and time consuming to don these garments compared to donning regular pants, boxer briefs, or compression shorts. Compared to other types of garments, these suits or pants typically require the help of a second person to properly position the suit and then to pull, push, and pinch the fabric of the suit onto the lower body of the wearer.

Notwithstanding the difficulties in donning such garments, they provide increased safety for the wearer during lifting activities and also supply additional support to increase the amount of weight the wearer can safely lift during a given activity. The fabric is taut and can withstand pressures up to several hundred pounds per square inch during the performance of a weightlifting exercise. As the wearer bends at the hips, up to several hundred pounds per square inch of pressure is placed on the garment fabric because of necessity to fit the garment tightly around the hips and legs. The pressure on the hip and leg areas of the garment in return pushes back on the hips and legs of the wearer to store energy. The stored energy is released as the wearer thrusts upward with the weight and returns to a standing position.

The body portion of traditional power briefs is made with openings for the legs. These are the only openings which permit ingress by a wearer. To don traditional power pants, the wearer must step in through the waist opening and try to extend his legs into the leg openings. This requires a great deal of effort to wriggle, tug, pinch, and push into the pants or briefs until the crotch of the garment is near or touching the crotch of the wearer.

As with the general population, weightlifters and powerlifters have differing physiques. For example, some have a large chest/torso and small hips. Others have a waist (measured circumferentially) smaller than their hips. Moreover, other weightlifter's hips and waist may be larger than the chest/torso. Conventional weightlifting garments must be large enough in the waist area for the buttocks to fit. Consequently, conventional garments are designed to be loose on the wearer's waist because the waist of the suit has to be large enough to accommodate wearers having differing combinations of hips, waist, and buttocks dimensions. Additionally, conventional garments lack the ability to adjust the tightness or looseness of the garment, either before, during, or after the garment is donned.

Therefore, a need exists for adjustable support pants or briefs for weightlifting or other activities involving lifting or thrusting motions which reduces the time and effort required to don the garment. A need also exists for a garment that accommodates wearers of different physiques by providing adjustability of the dimensions of the garment, while still providing support during athletic or work activities.

BRIEF SUMMARY

Those needs are addressed by embodiments of the invention in which first and second adjustable members are provided in the pants or briefs which increase the circumference of one or more of the hip and leg sections, and optional waist section, of the pants or briefs to reduce the time and effort needed to don (and take off) the garment. The adjustable features of the garment also permit the wearer to tighten one or more sections of the pants or briefs to accommodate the different physiques of wearers while providing a snug fit and support during athletic or work activities. As used herein, the term "garment" generally refers to a piece of clothing covering at least the hip section of a body and having separate openings for each leg. The term "pants" generally refers to an embodiment which includes waist and hips sections, along with leg openings as well as optional leg sections. The term "briefs" generally refers to an embodiment which has a hips support section with leg openings, but no waist or leg sections.

In accordance with one embodiment of the present invention, support pants are provided and comprise a relatively inelastic fabric which includes a waist section having a front portion and a back portion and a waist section circumference. Optionally, the garment includes a leg section including a pair of legs. The garment includes a pair of leg openings therein, and each of the leg openings has a leg opening circumference. The garment includes first and second adjustable members positioned on opposing sides of a sagittal plane of the support pants. The adjustable members extend generally longitudinally along at least one of the waist and optional leg sections. The adjustable members are adapted to increase or decrease at least one of the waist and leg opening circumferences.

In some embodiments, the adjustable members are selected from the group consisting of laces, zippers, hook and loop fasteners, snaps, buttons, or combinations thereof. Those skilled in the art will understand that other devices and materials may be used to form the adjustable members. In some embodiments, the front and back portions of the waist section are joined together at the sides thereof with an elastic material, and the adjustable members, such as for example laces, will overlie the elastic material. The elastic material may be in the form of a gusset and provides some degree of adjustability to the support pants, while restricting the range of motion of the adjustable members.

In some embodiments, the front and back portions of the waist section are joined together with an elastic material and the adjustable members overly the elastic material. In other embodiments, the front and back portions of the legs are joined together with an elastic material and the adjustable members overly the elastic material. The adjustable support pants may also include a crotch panel joined together with the leg sections.

In some embodiments, the first and second adjustable members extend from adjacent the top of the waist section to adjacent the bottom of the leg section. In one embodiment, the first and second adjustable members comprise zippers. In other embodiments, the first and second adjustable members comprise laces. The laces may be made from relatively inelastic material; however, in some embodiments, the laces may be made from an elastic material which can store energy during lifting activities. Various combinations of adjustable members are also within the scope of the invention such as, for example, the use of a combination of laces with a zipper, or a combination of a hook and loop fastener with laces.

In other embodiments, the adjustable support pants include third and fourth adjustable members. The third and fourth adjustable members may extend generally longitudinally (i.e., lengthwise) along opposite sides of the front portion of the waist section, or both front portions of the waist section and the leg section. The third and fourth adjustable members may be selected from the group consisting of laces, zippers, hook and loop fasteners, snaps, buttons, or combinations thereof. Those skilled in the art will understand that other devices and materials may be used to form the adjustable members.

In accordance with another embodiment of the present invention, support briefs are provided and comprise a relatively inelastic fabric which includes a hip support section having a front portion and a back portion and a hip support section circumference. The garment includes a pair of leg openings therein, and each of the leg openings has a leg opening circumference. The briefs include first and second adjustable members positioned on opposing sides of a sagittal plane of the support briefs. The adjustable members extend generally longitudinally along the hip support section. The adjustable members are adapted to increase or decrease at least one of the hip and leg opening circumferences.

In some embodiments, the adjustable members are selected from the group consisting of laces, zippers, hook and loop fasteners, snaps, buttons, or combinations thereof. Those skilled in the art will understand that other devices and materials may be used to form the adjustable members. In some embodiments, the front and back portions of the hip section are joined together at the sides thereof with an elastic material, and the adjustable members, such as for example laces, will overlie the elastic material. The elastic material may be in the form of a gusset and provides some degree of adjustability to the support briefs, while restricting the range of motion of the adjustable members.

In some embodiments, the first and second adjustable members extend from adjacent the top of the hip section to adjacent the leg openings. In one embodiment, the first and second adjustable members comprise zippers. In other embodiments, the first and second adjustable members comprise laces. The laces may be made from relatively inelastic material; however, in some embodiments, the laces may be made from an elastic material which can store energy during lifting activities. Various combinations of adjustable members are also within the scope of the invention such as, for example, the use of a combination of laces with a zipper, or a combination of a hook and loop fastener with laces.

In other embodiments, the adjustable support briefs include third and fourth adjustable members. The third and fourth adjustable members may extend generally longitudinally (i.e., lengthwise) along opposite sides of the front portion of the hip support section. The third and fourth adjustable members may be selected from the group consisting of laces, zippers, hook and loop fasteners, snaps, buttons, or combinations thereof. Those skilled in the art will understand that other devices and materials may be used to form the adjustable members.

In yet other embodiments of the support pants or briefs, alternative combinations and locations of the adjustable members are provided. For example, different sections of the support pants may include additional adjustable members. In addition, the adjustable members may be positioned in side-by-side relationship, or at angles to one another, to provide additional adjustment options for the user.

Accordingly, it is a feature of the present invention to provide first and second adjustable members in support pants or briefs which increase the circumference of one or more of the hip and leg sections, and optional waist section, of the garment to reduce the time and effort needed to don, and take off, the garment. The adjustable features of the support pants or briefs also permit the wearer to tighten one or more sections of the support pants or briefs to accommodate the different physiques of wearers while providing support during athletic or work activities. Other features and advantages of the present invention will be apparent from the following detailed description, the accompanying drawings, and the appended claims.

BRIEF DESCRIPTION OF THE SEVERAL VIEWS OF THE DRAWINGS

The following detailed description of specific embodiments of the present invention are presented by way of example and can be best understood when read in conjunction with the following drawings, where like structure is indicated with like reference numerals and in which.

DETAILED DESCRIPTION

Figure 1:
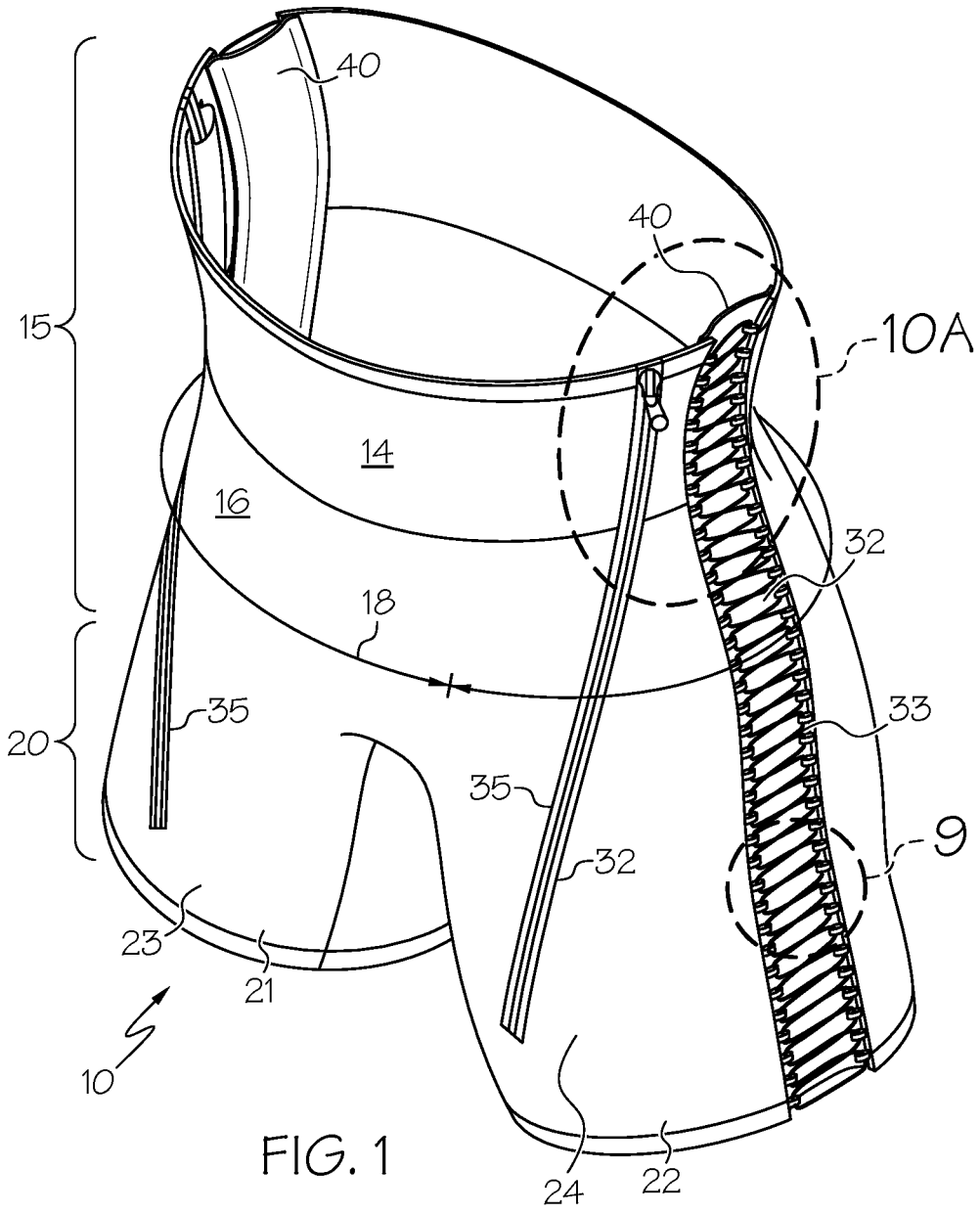
FIG. 1 is a perspective view of one embodiment of the adjustable support pants.
Figure 2:
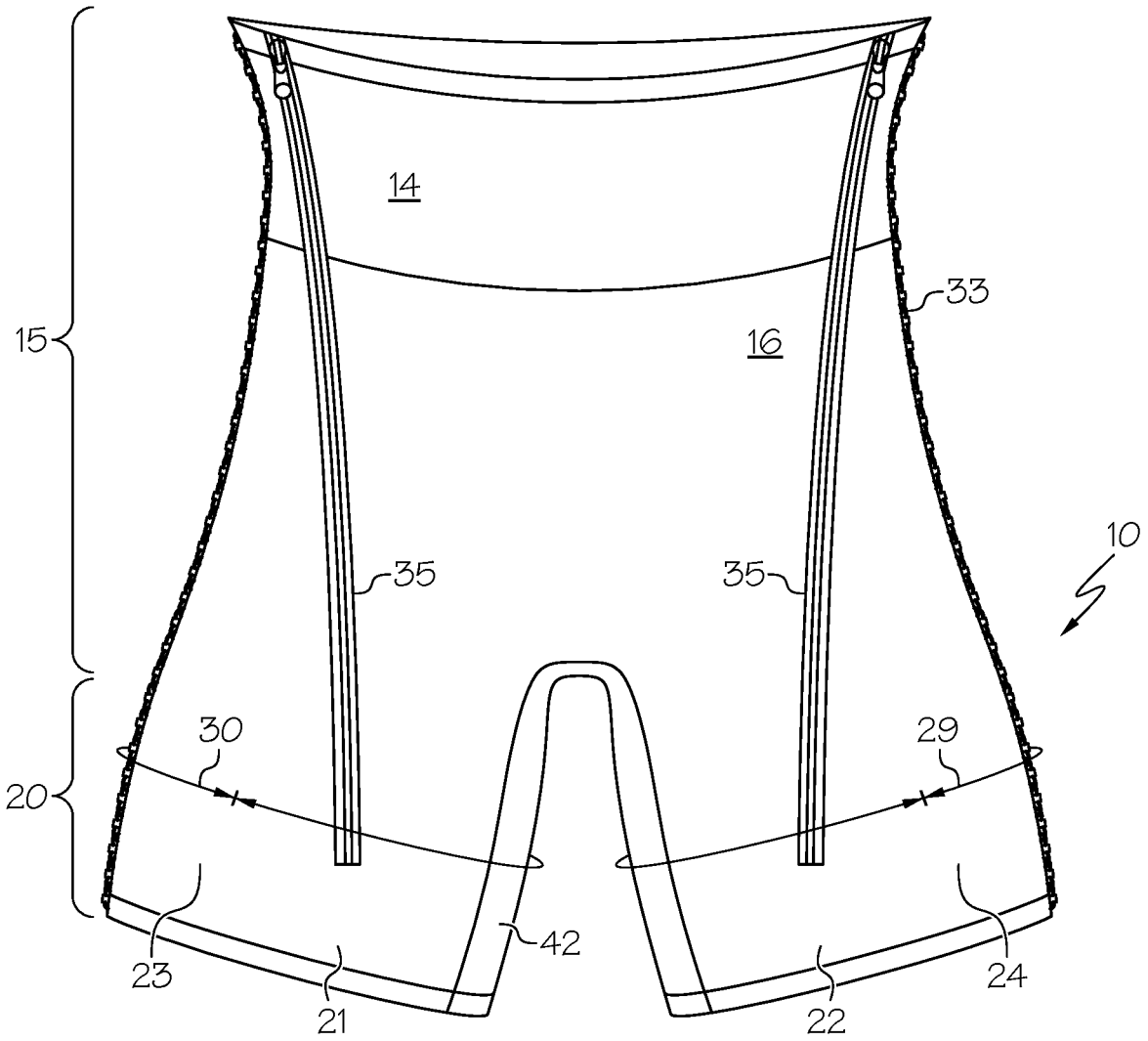
FIG. 2 is a front view of the adjustable support pants of FIG. 1.
Figure 3:
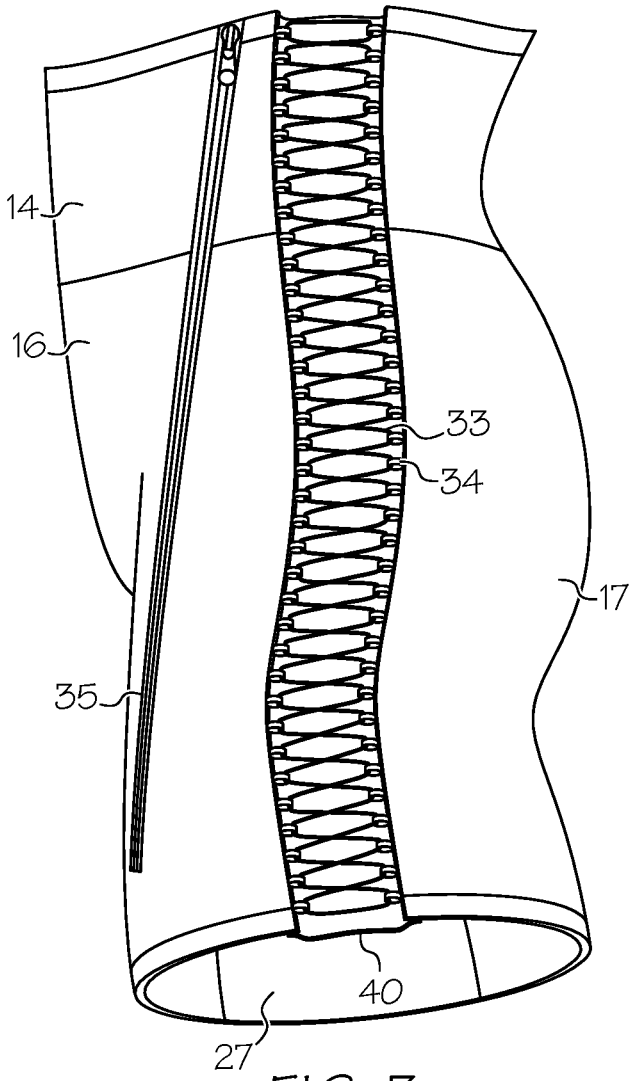
FIG. 3 is a side view of the adjustable support pants of FIG. 1.
Figure 4:
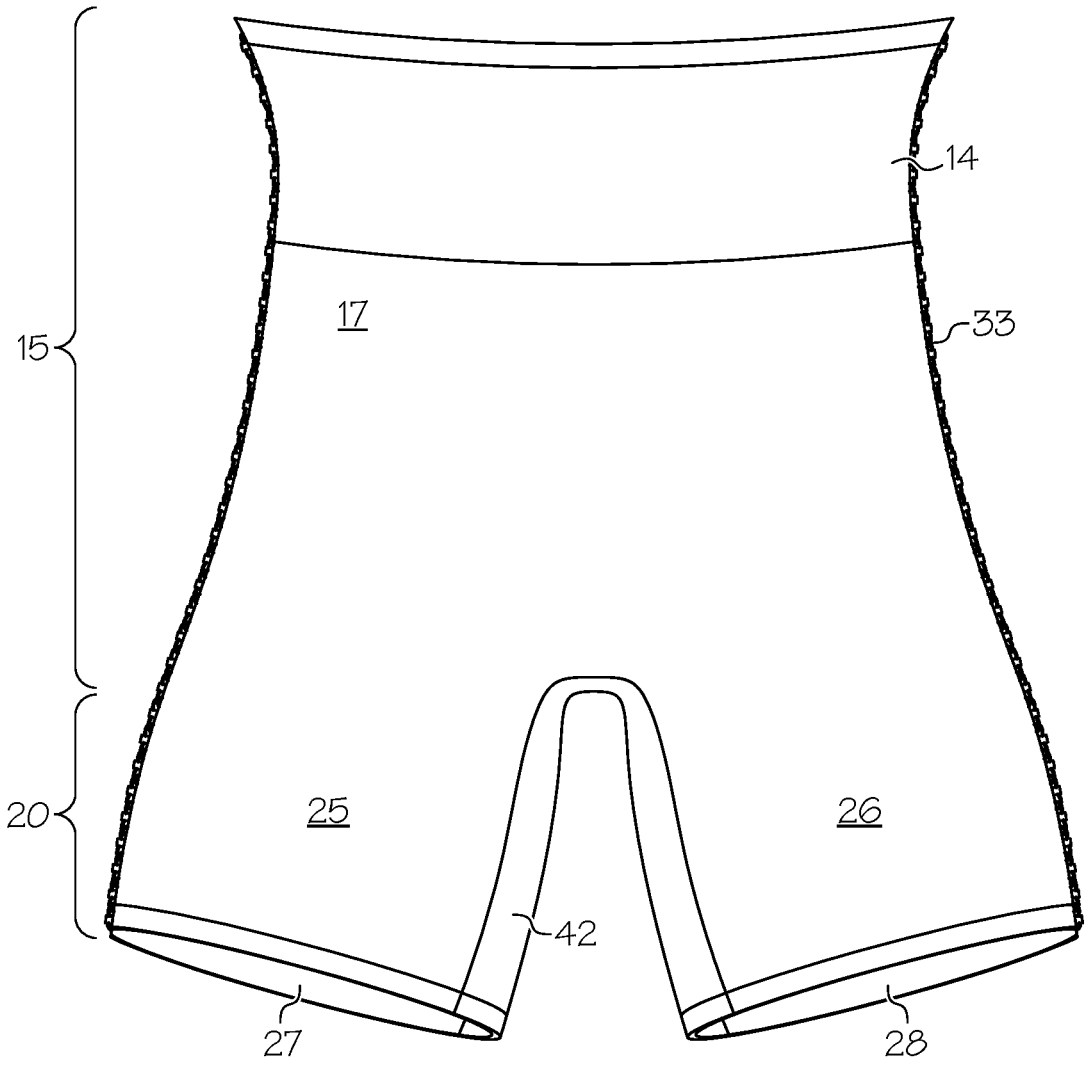
FIG. 4 is a rear view of the adjustable support pants of FIG. 1.
Figure 5:
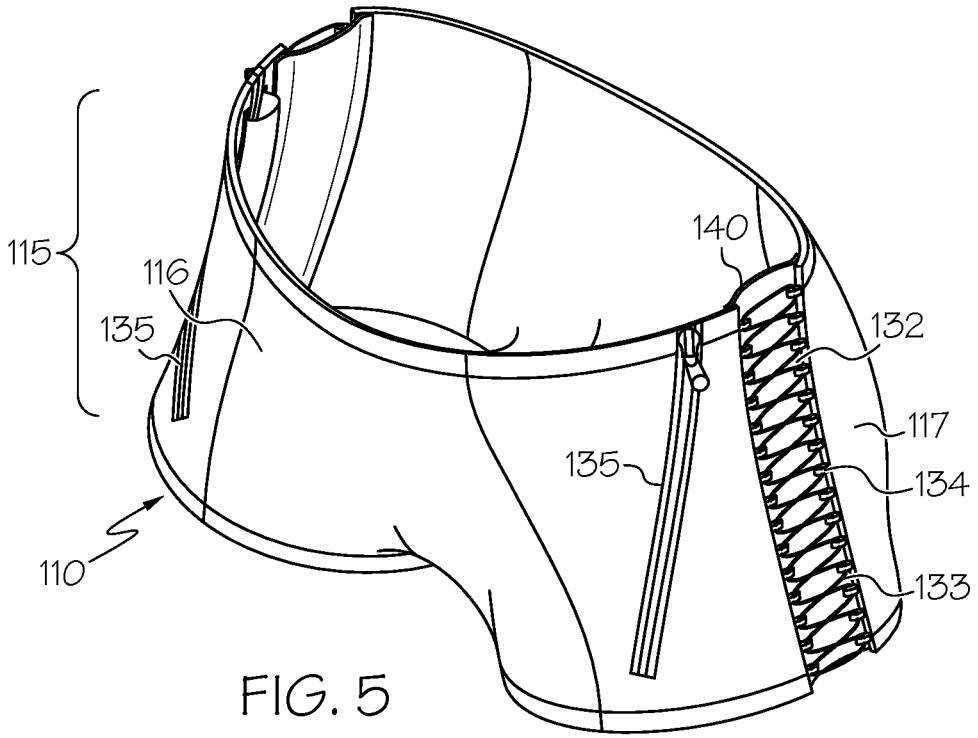
FIG. 5 is a perspective view of an embodiment of the adjustable support briefs.
Figure 6:
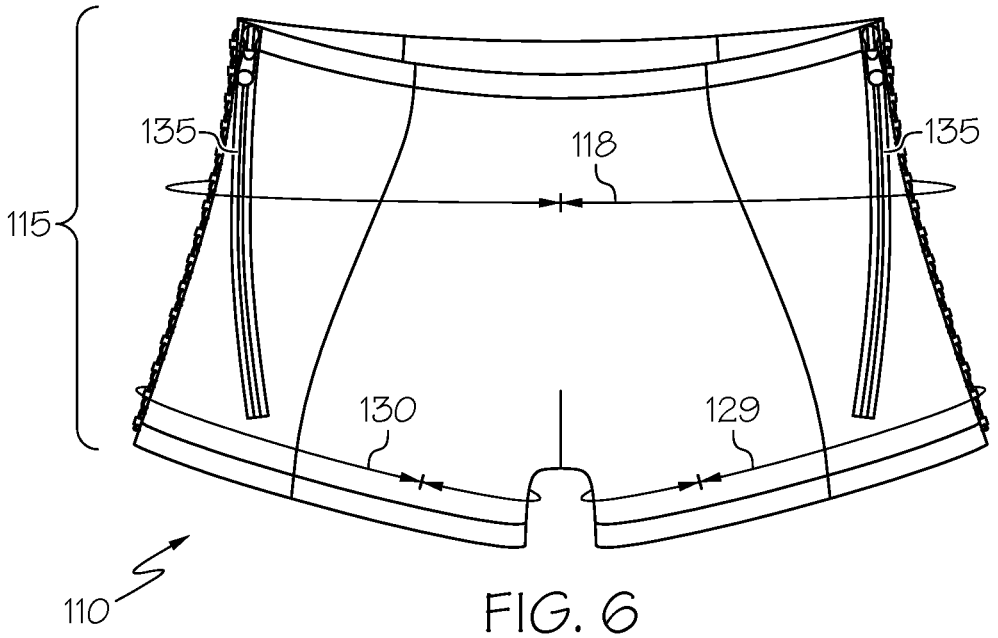
FIG. 6 is a front view of the adjustable support briefs of FIG. 5.
Figure 7:
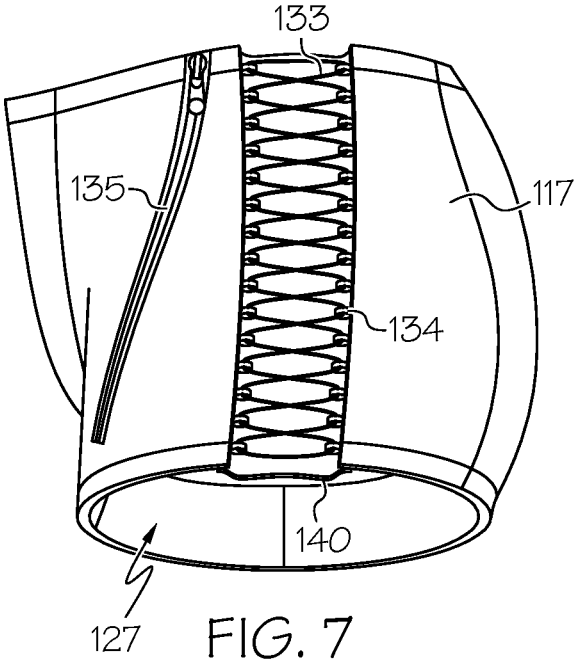
FIG. 7 is a side view of the adjustable support briefs of FIG. 5.
Figure 8:
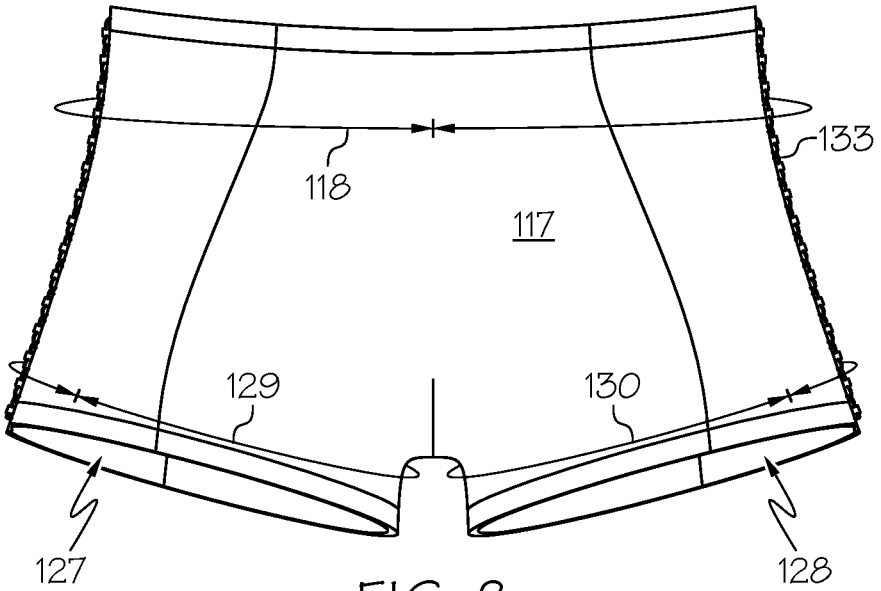
FIG. 8 is a rear view of the adjustable support briefs of FIG. 5.

Referring initially to a first embodiment illustrated in FIGS. 1-4, adjustable support pants 10 are shown and which include a waist section generally indicated at 15, and a leg section generally indicated at 20. The adjustable pants 10 are preferably made from a high tensile strength (e.g., 90 psi or greater), relatively inelastic material such as single or multiply polymeric fabric including polyester or nylon, and natural fibers including cotton (such as, for example, canvas or denim). By "relatively inelastic" it is meant that the fabric does not noticeably stretch when subjected to the stresses and strains associated with its use in a variety of lifting activities. The material forming pants 10 may comprise a solid sheet of material, or may be of woven fabric.

Waist section 15 includes a front portion 16 and a back portion 17. The pants provide a waist section circumference 18. In this embodiment, the pants include a lumbar support section 14 positioned around the upper portion of the waist section. Lumbar support 14 encircles the midsection and lower lumbar region of the wearer to provide additional support during lifting. Lumbar support 14 may be integral with waist section 15, or may be formed from a separate piece of fabric which is secured (e.g., by stitching) to the waist section. Also included within waist section 15 is support for the hips of a wearer.

Leg section 20 includes a pair of legs 21, 22, each having respective leg openings 27, 28, and with each leg having respective front 23, 24 and back 25, 26 portions. Each of the legs also has respective leg opening circumferences 29, 30. A crotch panel 42 provides support to the wearer. Sections of the adjustable support pants may be fabricated from a unitary piece of fabric, or may be fabricated from pieces of fabric stitched or otherwise bonded or adhered together.

To aid in making it easier for a wearer to put on and take off the garment, adjustable support pants 10 include first and second adjustable members 32 which are adapted to increase or decrease at least one of the waist and leg opening circumferences. The materials used in the adjustable member are selected so that the adjustable member has a tensile strength that is able to withstand the stresses and strains placed on the suit during a variety of lifting activities. Typically, the materials are selected to be able to withstand stresses of up to several hundred pounds. The adjustable members may comprise laces 33, zippers 35, hook and loop fasteners 36, snaps 37, buttons 38, or any other suitable means which provides the capability of adjusting the circumference of one or more sections of the support pants. As shown, the adjustable members, in this embodiment zippers and laces, are positioned on opposite sides of a sagittal plane of the support pants (i.e., a vertical plane passing from the anterior of the garment to the posterior, dividing the pants into right and left halves).

Figure 10A:
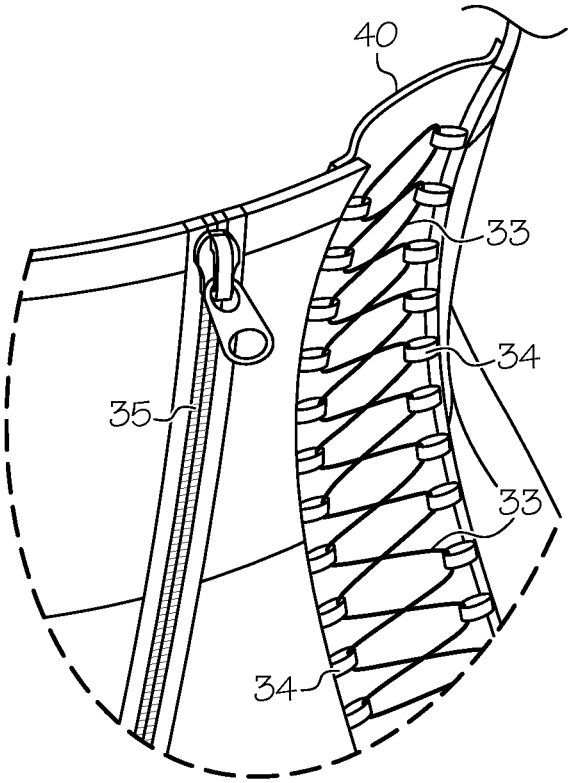
FIG. 10A is an enlarged view of the zipper and laces in the waist section of the adjustable support pants of FIG. 1.
Figure 10B:
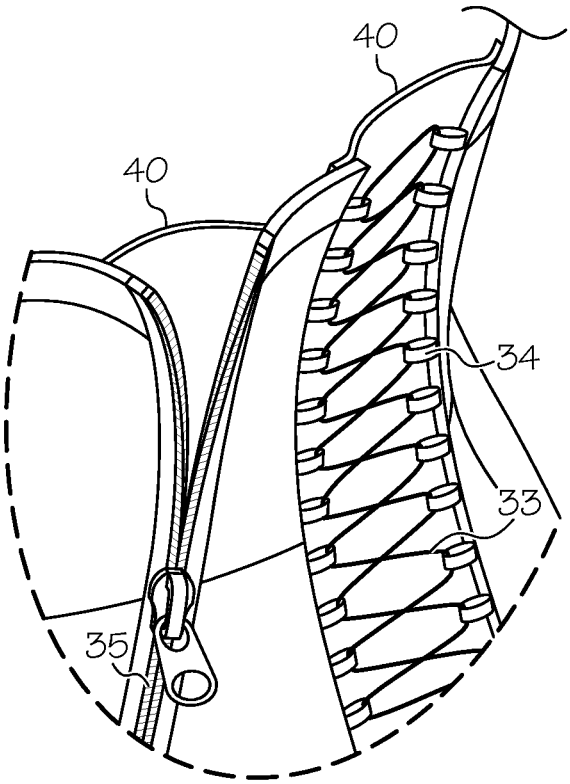
FIG. 10B is an enlarged view of the zipper, partially unzipped, elastic material behind the zipper, and laces in the waist section of the adjustable support pants of FIG. 1.

To provide further adjustability, and as best shown in FIGS. 10A and 10B, one or more of the respective front and back portions of one or more of the waist and leg sections of the garment are joined together with an elastic material 40. In this embodiment, elastic material 40 forms a gusset and may comprise a fabric woven to provide some degree of stretch when pulled. The elastic material 40 may comprise an elastomer such as Neoprene® rubber. Alternatively, the elastic material may comprise a fabric having an elastomeric material woven therein such as a Lycra® or Spandex® fabric. As such, the elastic material 40 has an elasticity greater than an elasticity of the fabric of the pants 10. Elastic material 40 may be sewn to or otherwise bonded to the respective front and back portions 16, 17 of, for example, waist section 15. In some embodiments, the elastic material 40 continuously extends generally longitudinally along substantially the entire length of the waist section 15 and the leg section 20.

In the embodiment illustrated, there are four adjustable members, two zippers 35 and two sets of laces 33. Laces 33 extend substantially longitudinally (i.e., lengthwise) along the length of the waist and leg sections of the support pants, adjustably joining together respective front and back portions of the waist and leg sections. The laces may comprise any suitable length of material which will withstand the stresses and strains of supporting the wearer. The laces may be made of woven fabric or of a solid length of material, and may include a reinforcing core. For example, there are several grades of paracord (parachute cord) that are commercially available which are suitable for use as laces. Generally, paracord is fabricated from a lightweight, braided material such as nylon, cotton, polyester, or polypropylene which is woven around a core material. Paracord is relatively inelastic. Alternatively, one can use an elastic cord such as cord material commonly-known as Bungee cord. Typically, Bungee cord includes a lightweight braided exterior layer woven around a core of natural or synthetic rubber. Such elastic cord material will stretch when placed under sufficient strain. When engaging in lifting activities, the laces will stretch and store energy which is then released to aid the lifter.

Figure 9:
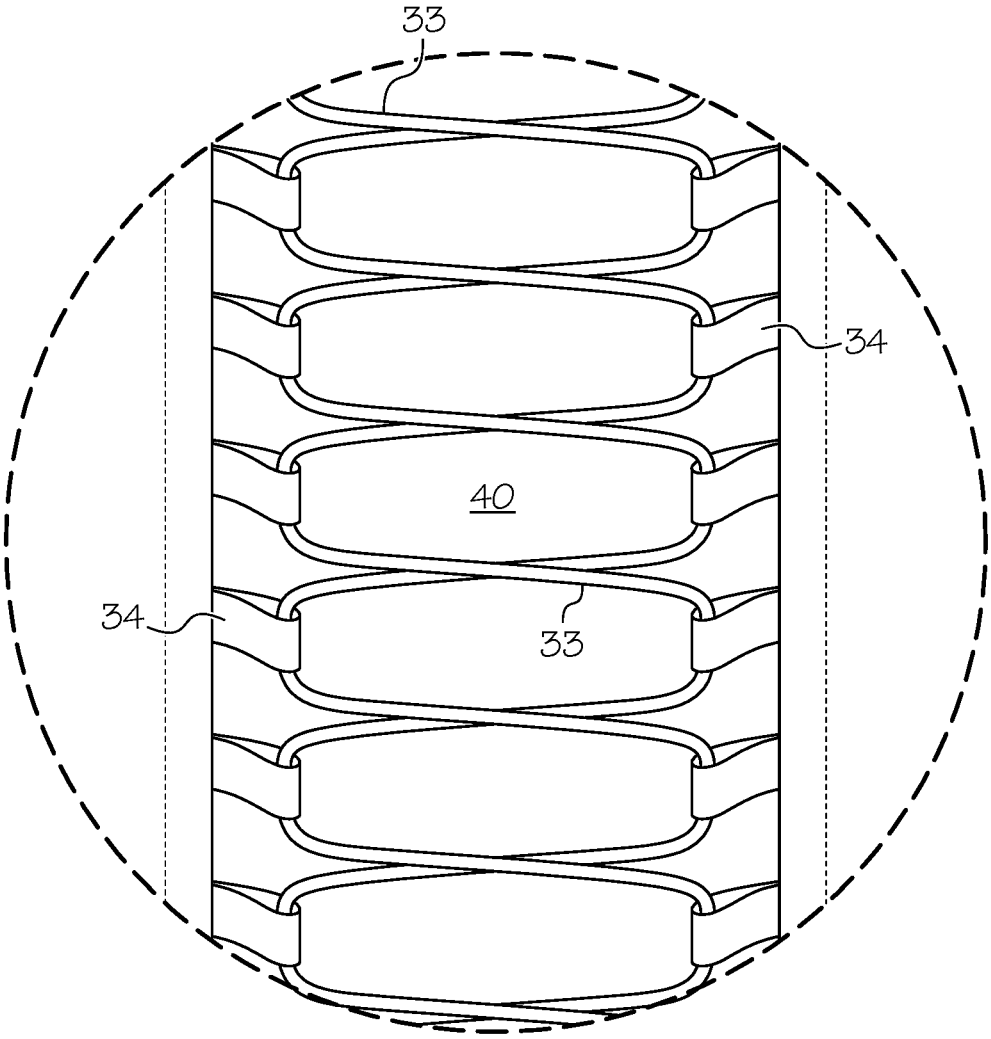
FIG. 9 is an enlarged side view, in section, of the arrangement of the laces of the adjustable support pants of FIG. 1.

As best seen in FIG. 9, laces 33 are laced in a criss-cross fashion through fabric loops 34 and then may be tightened and tied off as is conventional. While loops are shown, it will be apparent to those skilled in the art that eyelets or other holes, openings, or perforations may be utilized. When loosened, the laces, and elastic material 40, permit the circumferences of the waist and leg sections of support pants 10 to increase so that a user may more easily don the garment. Once in the support pants, the wearer can tighten the laces to create a snug fit which provides support to the hips of a wearer.

Similarly, zippers 35 extend substantially longitudinally along the length of the front portions of the waist and leg sections of the support pants. As shown, the zippers may be angled from a generally vertical orientation. Typically, the zippers are angled at between about 10° to about 30° from vertical. As with the laces, when zippers 35 are unzipped, the waist and leg section circumferences of the support pants increase so that a user may more easily don the garment. The zippers can then be zipped to a closed position to provide a snug fit for the wearer.

Figure 11:
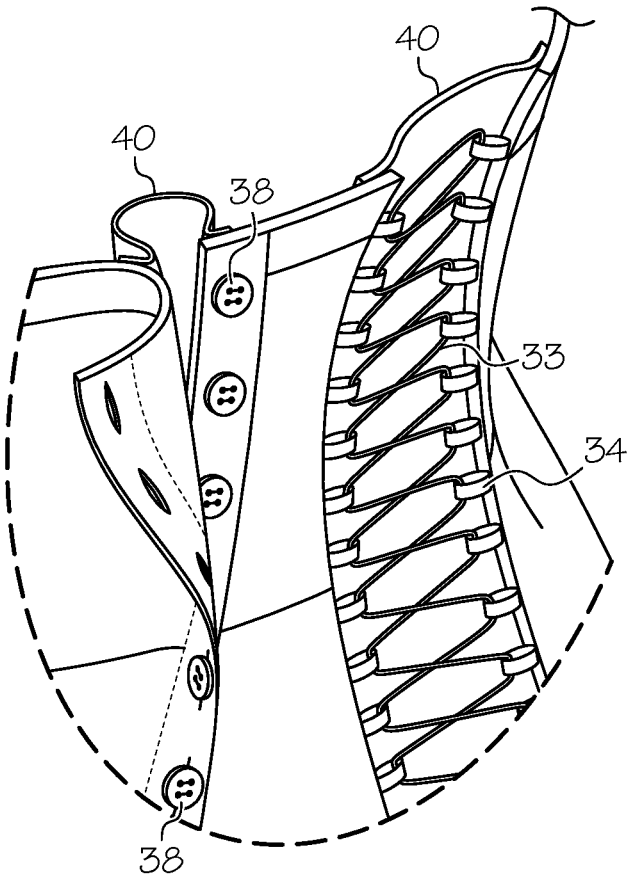
FIG. 11 is an enlarged section showing detail for an alternative embodiment of the adjustable support pants.
Figure 12:
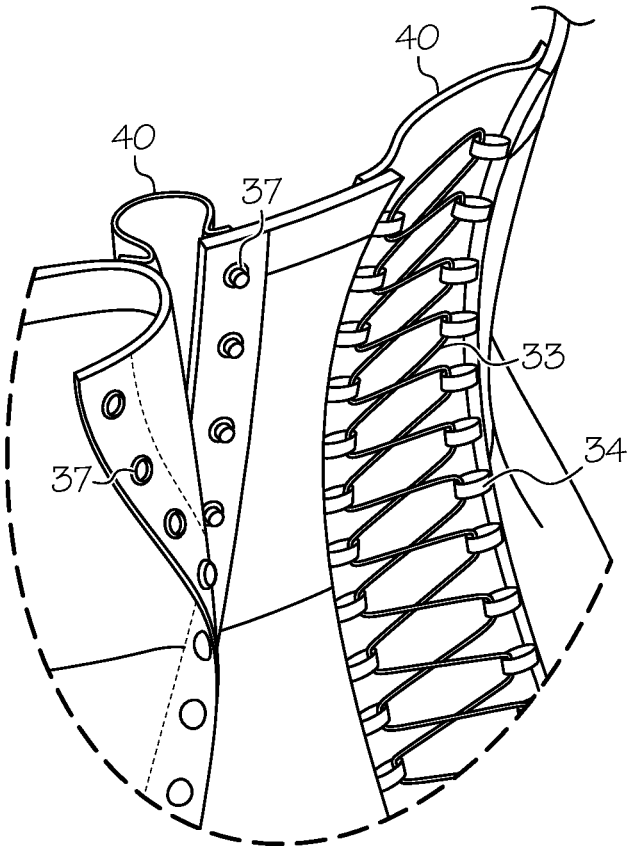
FIG. 12 is an enlarged section showing detail for an alternative embodiment of the adjustable support pants.

Alternatively, laces 33 or zippers 35 may be replaced by buttons 38 (see, FIG. 11), hook and loop fasteners 36 (see FIG. 13), or snaps 37 (see FIG. 12). In each alternative embodiment, unbuttoning the buttons, separating the hook and loop fasteners, or unsnapping the snaps allows the circumferences of the waist and leg sections of the support pants to increase, making it easier for a user to don the garment. Generally, all of these adjustable members are interchangeable, and different combinations of any of them may be utilized.

Referring now to FIGS. 5-8, another embodiment of the adjustable support briefs is illustrated. Adjustable support briefs 110 are shown which include a hip support section generally indicated at 115. Briefs 110 do not include a separate leg section, although there are respective leg openings 127, 128. As in the previous embodiment, the support briefs 110 are preferably made from a high tensile strength (e.g., 90 psi or greater), relatively inelastic material such as single or multi-ply polymeric fabric including polyester or nylon, and natural fibers including cotton (such as, for example, canvas or denim).

Hip support section 115 includes a front portion 116 and a back portion 117. The support briefs provide a hip support section circumference 118. Leg openings 127, 128, respectively, are provided. Each leg opening has a respective circumference 129, 130. Sections of the adjustable briefs may be fabricated from a unitary piece of fabric, or may be fabricated from pieces of fabric stitched or otherwise bonded or adhered together.

To aid in making it easier for a wearer to put on and take off the garment, adjustable support briefs 110 include first and second adjustable members 132 which are adapted to increase or decrease at least one of the hip and leg opening circumferences. As in the previous embodiment, the adjustable members are positioned on opposites sides of a sagittal plane of the support briefs. The adjustable members may comprise laces 133, zippers 135, hook and loop fasteners, snaps, buttons, or any other suitable means which provides the capability of adjusting the circumference of one or more sections of the garment. To provide further adjustability, one or more of the respective front and back portions of the hip support section of the garment may be joined together with an elastic material (not shown; see FIGS. 10A and 10B of previous embodiment). The elastic material may be sewn to or otherwise bonded to the respective front and back portions 116, 117 of, for example, hip support section 115.

In the embodiment illustrated in FIGS. 5-8, there are four adjustable members, two zippers 135 and a pair of laces 133. Each of the laces 133 extend substantially longitudinally along the length of the hip support section of the support briefs, adjustably joining together respective front and back portions of the hip section of the garment. The laces may comprise any suitable length of material which will withstand the stresses and strains of supporting the wearer.

As in previous embodiments, laces 133 are laced in a criss-cross fashion through fabric loops 134 and then may be tightened and tied off as is conventional. It will be apparent to those skilled in the art that eyelets or other holes, openings, or perforations may be utilized. When loosened, the laces, and elastic material, permit the circumference of the hip section and the circumferences of the leg openings of support briefs 110 to increase so that a user may more easily don the garment. Once in the briefs, the wearer can tighten the laces to create a snug fit.

Similarly, zippers 135 extend substantially longitudinally along the length of the front portions of the hip support section 115 of the suit. As shown, the zippers may be angled from a generally vertical orientation. Typically, the zippers are angled at between about 10° to about 30° from vertical. As with the laces, when zippers 135 are unzipped, the hip support section circumference of the suit increases so that a user may more easily don the garment. The zippers can then be zipped to a closed position to provide a snug fit for the wearer.

Figure 13:
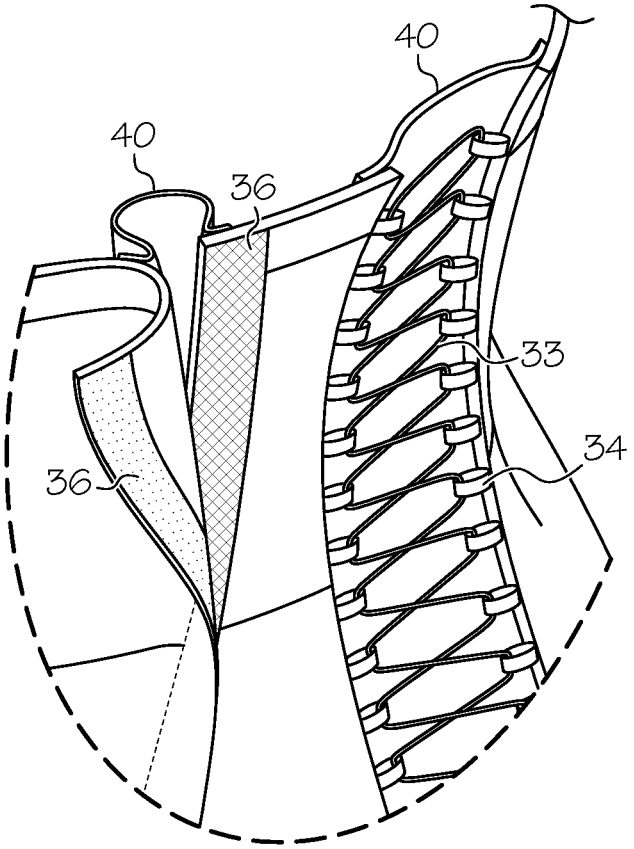
FIG. 13 is an enlarged section showing detail for an alternative embodiment of the adjustable support pants.

As in previous embodiments, laces 133 or zippers 135 may be replaced by buttons. hook and loop fasteners, or snaps as shown in FIGS. 11-13. In each alternative embodiment, unbuttoning the buttons, separating the hook and loop fasteners, or unsnapping the snaps allows the circumferences of the hip section and leg openings of the support briefs to increase, making it easier for a user to don the garment. Generally, all of these adjustable members are interchangeable, and different combinations of any of them may be utilized.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Unless the meaning is clearly to the contrary, all ranges set forth herein are deemed to be inclusive of all values within the recited range as well as the endpoints.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. Adjustable support pants comprising:

a fabric and including a waist section having a front portion and a back portion and a waist section circumference and a leg section including a pair of legs, each of said legs including a leg opening, each of said leg openings having a leg opening circumference;

said front and back portions of said waist and leg sections joined together with an elastic material positioned on opposite sides of a sagittal plane of said adjustable support pants and continuously extending generally longitudinally along substantially the entire length of said waist and leg sections; and first and second adjustable members positioned on opposite sides of said sagittal plane of said adjustable support pants and extending generally longitudinally along substantially the entire length of said waist and leg sections, said first and second adjustable members adapted to increase or decrease said waist and leg opening circumferences, said first and second adjustable members comprising laces overlying said elastic material.

2. The adjustable support pants as claimed in claim 1 in which said laces comprise an elastic material.

3. The adjustable support pants as claimed in claim 1 further including third and fourth adjustable members, said third and fourth adjustable members positioned on opposite sides of said sagittal plane of said adjustable support pants and extending generally longitudinally along at least one of said waist section and said leg section.

4. The adjustable support pants as claimed in claim 3 in which said third and fourth adjustable members comprise zippers.

5. The adjustable support pants as claimed in claim 4 in which said third and fourth adjustable members extend generally longitudinally along opposite sides of the length of said front portion of said waist section.

6. The adjustable support pants as claimed in claim 4 in which said third and fourth adjustable members extend diagonally along opposite sides of the length of said front portion of said waist section.

7. The adjustable support pants as claimed in claim 4 in which said third and fourth adjustable members are selected from the group consisting of laces, zippers, hook and loop fasteners, snaps, or buttons.

8. The adjustable support pants as claimed in claim 1 further including a lumbar support section positioned around an upper portion of said waist section.

9. The adjustable support pants as claimed in claim 8 in which said lumbar support section is integral with said waist section.

10. The adjustable support pants as claimed in claim 1 in which said leg section includes a crotch panel sewn to said pair of legs of said leg section.

11. Adjustable support briefs comprising:

a fabric and including a hip support section having a front portion and a back portion and a hip support section circumference, said adjustable support briefs including a pair of leg openings, each of said leg openings having a leg opening circumference;

said front and back portions of said hip support section joined together with an elastic material positioned on opposite sides of a sagittal plane of said adjustable support briefs and continuously extending generally longitudinally along substantially the entire length of said hip support section; and first and second adjustable members positioned on opposite sides of said sagittal plane of said adjustable support briefs and extending generally longitudinally along substantially the entire length of said hip support section, said first and second adjustable members adapted to increase or decrease said hip support section circumference and said leg opening circumferences, said first and second adjustable members comprising laces overlying said elastic material.

12. The adjustable support briefs as claimed in claim 11 in which said laces comprise an elastic material.

13. The adjustable support briefs as claimed in claim 11 in which said hip support section has a top and a bottom and wherein said first and second adjustable members extend from adjacent the top of said hip support section to adjacent said leg openings.

14. The adjustable support briefs as claimed in claim 11 further including third and fourth adjustable members.

15. The adjustable support briefs as claimed in claim 14 in which said third and fourth adjustable members comprise zippers.

16. The adjustable support briefs as claimed in claim 14 in which said third and fourth adjustable members extend generally longitudinally along opposite sides of the length of said front portion of said hip support section.

17. The adjustable support briefs as claimed in claim 14 in which said third and fourth adjustable members extend diagonally along opposite sides of the length of said front portion of said hip support section.

18. The adjustable support briefs as claimed in claim 14 in which said third and fourth adjustable members are selected from the group consisting of laces, zippers, hook and loop fasteners, snaps, or buttons.

19. Adjustable support pants comprising:

a fabric including a waist section having a front portion and a back portion and a waist section circumference, and a leg section including a pair of legs, said adjustable support pants including a pair of leg openings, each of said leg openings having a leg opening circumference;

said front and back portions of said waist and leg sections joined together with an elastic material positioned on opposite sides of a sagittal plane of said adjustable support pants and extending generally longitudinally along substantially the entire length of said waist and leg sections;

first and second adjustable members positioned on opposite sides of said sagittal plane of said adjustable support pants and extending generally longitudinally along the length of said waist and leg sections, said first and second adjustable members adapted to increase or decrease said waist section circumference and said leg opening circumferences; and further including third and fourth adjustable members, said third and fourth adjustable members positioned on opposite sides of said sagittal plane of said adjustable support pants and extending generally longitudinally along both of said waist and leg sections.

20. The adjustable support pants as claimed in claim 19 in which said third and fourth adjustable members comprise zippers.

21. Adjustable support briefs comprising:

a fabric and including a hip support section having a front portion and a back portion and a hip support section circumference, said adjustable support briefs including a pair of leg openings, each of said leg openings having a leg opening circumference;

said front and back portions of said hip support section joined together with an elastic material positioned on opposite sides of a sagittal plane of said adjustable support briefs and extending generally longitudinally along substantially the entire length of said hip support section;

first and second adjustable members positioned on opposite sides of said sagittal plane of said adjustable support pants and extending generally longitudinally along the length of said hip support section, said first and second adjustable members adapted to increase or decrease said hip and leg opening circumferences; and third and fourth adjustable members extending along the length of said hip support section.

22. Adjustable support briefs as claimed in claim 21 in which said third and fourth adjustable members comprise zippers.

* * * * *